US009136640B2

(12) United States Patent
Liu

(10) Patent No.: US 9,136,640 B2
(45) Date of Patent: Sep. 15, 2015

(54) HEAVY-DUTY STRAIGHT-BLADE ELECTRICAL CONNECTOR WITH ENGAGEMENT-FACILITATING FEATURES

(71) Applicant: Drew Sying Liu, Racine, WI (US)

(72) Inventor: Drew Sying Liu, Racine, WI (US)

( * ) Notice: Subject to any disclaimer, the term of this patent is extended or adjusted under 35 U.S.C. 154(b) by 150 days.

(21) Appl. No.: 14/047,450

(22) Filed: Oct. 7, 2013

(65) Prior Publication Data

US 2014/0099813 A1 Apr. 10, 2014

Related U.S. Application Data

(60) Provisional application No. 61/710,824, filed on Oct. 8, 2012.

(51) Int. Cl.

| | |
|---|---|
| ***H01R 13/62*** | (2006.01) |
| ***H01R 13/58*** | (2006.01) |
| ***H01R 13/633*** | (2006.01) |
| *H01R 13/622* | (2006.01) |
| *H01R 24/30* | (2011.01) |

(52) U.S. Cl.

CPC ..... *H01R 13/58* (2013.01); *H01R 13/633* (2013.01); *H01R 13/622* (2013.01); *H01R 24/30* (2013.01)

(58) Field of Classification Search

USPC ..... 439/320, 142, 144, 484, 483

IPC ..... H01R 13/622,13/5219, 13/623, 13/639, H01R 13/6335, 2103/00, 24/28

See application file for complete search history.

(56) References Cited

U.S. PATENT DOCUMENTS

| | | | | | |
|---|---|---|---|---|---|
| 2,030,115 | A | * | 2/1936 | Muldoon | 439/484 |
| 3,270,267 | A | * | 8/1966 | Nolte, Jr. | 320/138 |
| 3,850,495 | A | * | 11/1974 | Glover | 439/273 |
| 4,310,213 | A | * | 1/1982 | Fetterolf et al. | 439/320 |
| 4,390,226 | A | * | 6/1983 | Hohn | 439/261 |
| 5,100,341 | A | * | 3/1992 | Czyz et al. | 439/447 |
| 5,454,731 | A | * | 10/1995 | Dickie | 439/484 |
| 5,545,046 | A | * | 8/1996 | Masuda et al. | 439/142 |

OTHER PUBLICATIONS

StayOnline. Power Connectivity Products. NEMA Straight Blade Reference Chart. www.stayonline.com/referencene-nema-straight-blade. 3 pages.

Leviton. Straight Blade Connectors. www.leviton.com. 8 pages. Date: Copyright 2012-2014.

* cited by examiner

*Primary Examiner* — Hien Vu

(74) *Attorney, Agent, or Firm* — Jansson Munger McKinley and Shape Ltd.

(57) ABSTRACT

A straight-blade, cord-end-connected electrical connector for connection to a connector-engaging member. The connector has a connector-body main portion including a forward portion terminating in a connecting face presenting the engagement means of the connector for axial engagement with the engagement means of the connector-engaging member. The connector also includes a connector-body cord-engagement portion for permanent trans-axial securement of the cord to the main portion and a rearward gripping portion for facilitating manual engagement/disengagement of the connector with the connector-engaging member.

15 Claims, 3 Drawing Sheets

HEAVY-DUTY STRAIGHT-BLADE ELECTRICAL CONNECTOR WITH ENGAGEMENT-FACILITATING FEATURES

RELATED APPLICATION

This application claims the benefit of provisional application Ser. No. 61/710,824 filed on Oct. 8, 2012.

FIELD

This invention is related generally to electrical connectors and, more specifically, electrical connectors for heavy-duty high-amperage uses.

BACKGROUND

Electrical connectors of the prior art exist in many forms and are characterized by factors such as their pinout, physical construction, size, contact resistance, insulation between pins, ruggedness and resistance to vibration, resistance to entry of water or other contaminants, resistance to pressure, reliability, lifetime and ease of connecting and disconnecting. Electrical connectors of the prior art may be keyed to prevent insertion in the wrong orientation. Electrical connectors may also include various locking mechanisms to verify that they are fully inserted and unable to be accidentally withdrawn.

Electrical connectors which are heavy-duty and used for high-amperage applications are typically used in either outdoor or indoor settings and for a variety of purposes such as power-supply connections to vehicles, appliances and the like. It is to heavy-duty high-amperage electrical connectors that this invention is primarily directed.

In the electrical connector field, there is a need for an improved electrical connector which can be used for heavy-duty high-amperage applications, inexpensive to manufacture, and easy for the user to engage/disengage from the power source. This device meets these needs and overcomes problems and shortcomings in the prior art.

SUMMARY

The device is a straight-blade, cord-end-connected electrical connector for connection to a connector-engaging member. This device is for heavy-duty, high-amperage electrical power cords and connectors such as are used for power-supply connections to vehicles, appliances and the like.

The electrical connector of the invention includes the connector and connector-engaging member which have slidably-engageable corresponding male-female engagement means. The connector includes a connector-body main portion having a forward portion terminating in a connecting face presenting the engagement means of the connector for axial engagement with the engagement means of the connector-engaging member. The connector also includes a connector-body cord-engagement portion for permanent trans-axial securement of the cord to the main portion and a rearward gripping portion for facilitating manual engagement/disengagement of the connector with the connector-engaging member.

In preferred embodiments, the gripping portion is a finger-receiving loop which is rearward of and integrally formed with the remainder of the connector-body main portion. The axial engagement movement is along a forward-rearward axis extending through the connecting face and the finger-receiving loop is substantially along such axis.

In preferred embodiments, the connector also includes a grip-bar configured for insertion through the loop to facilitate firm gripping for disengagement/engagement purposes and a tether between the grip-bar and the connector-body main portion.

Preferably, the connector-body main portion, the connector-body cord portion, and the rearward finger-receiving loop are an integrally formed polymeric piece. It is also preferable that the grip-bar and the tether are integrally formed with the connector-body main portion.

The electrical connector also includes a connecting ring encircling and loosely rotatable about the forward portion of the connector-body main portion. The connecting ring has a rearward inwardly-extending flange terminating at a circular inner edge, a forward circular edge which is rearward of the connecting face, and a threaded inward wall for threaded engagement with a threaded annulus of the connector-engaging member. It is highly preferable that the forward portion of the connector-body main portion has forward and rearward outwardly-extending flanges between which the inwardly-extending flange of the connecting ring is located, thereby holding the connecting ring on the connector-body forward portion while allowing rotation thereabout for engagement with the threaded annulus of the connector-engaging member.

In highly preferred embodiments, the connector-body cord-engagement portion includes a wire-connection portion immediately rearward of the forward portion and along a forward-rearward axis extending through the connecting face and a cord-receiving sleeve portion extending trans-axially from the wire-connection portion. Preferably, the cord-receiving sleeve portion is angled off-perpendicular with respect to the forward-rearward axis and is of sufficient length to form a pistol grip of the connector-body main portion.

In preferred embodiments, the rearward gripping portion includes at least the cord-receiving sleeve portion. In other preferred embodiments, the rearward gripping portion also includes a finger-receiving loop rearward of and integrally formed with the remainder of the connector-body main portion.

The subject connector has many advantages over the prior art. For example, the fact that the cable leaves the connector at an angle, rather than straight out, reduces the strain on the blades and terminal caused by the considerable weight of the cable and/or by pulling the connector out by pulling the cable. Additionally, the ring, which is at the back end of the connector, greatly facilitates insertion, and particularly, removal of the connector.

The inventive combinations of elements of the invention are laid out in the claims below.

DETAILED DESCRIPTION OF PREFERRED EMBODIMENTS

The figures and the descriptions below serve to describe details of the device and its preferred embodiments.

As shown in FIGS. 1-6, this device is a straight-blade, cord-end-connected electrical connector 10 for connection to a connector-engaging member 12. This device is traditionally used for heavy-duty, high-amperage electrical power cords and connectors such as are used for power-supply connections to vehicles and the like.

Figure 1:
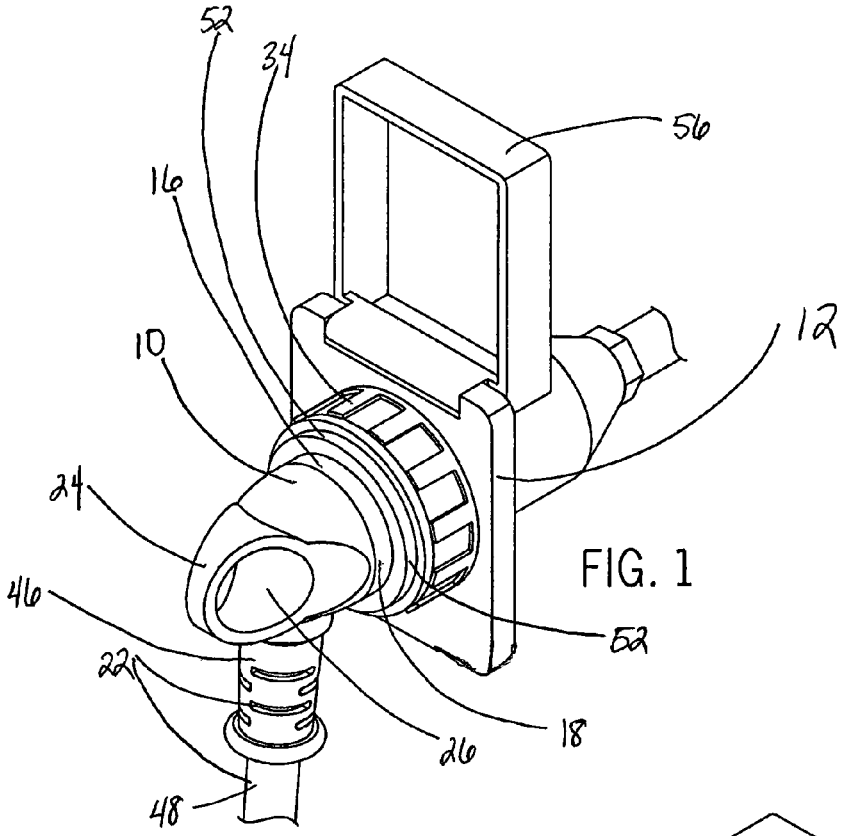
FIG. 1 is a perspective view of the electrical connector and connector-engaging member of the application in the engaged position.
Figure 2:
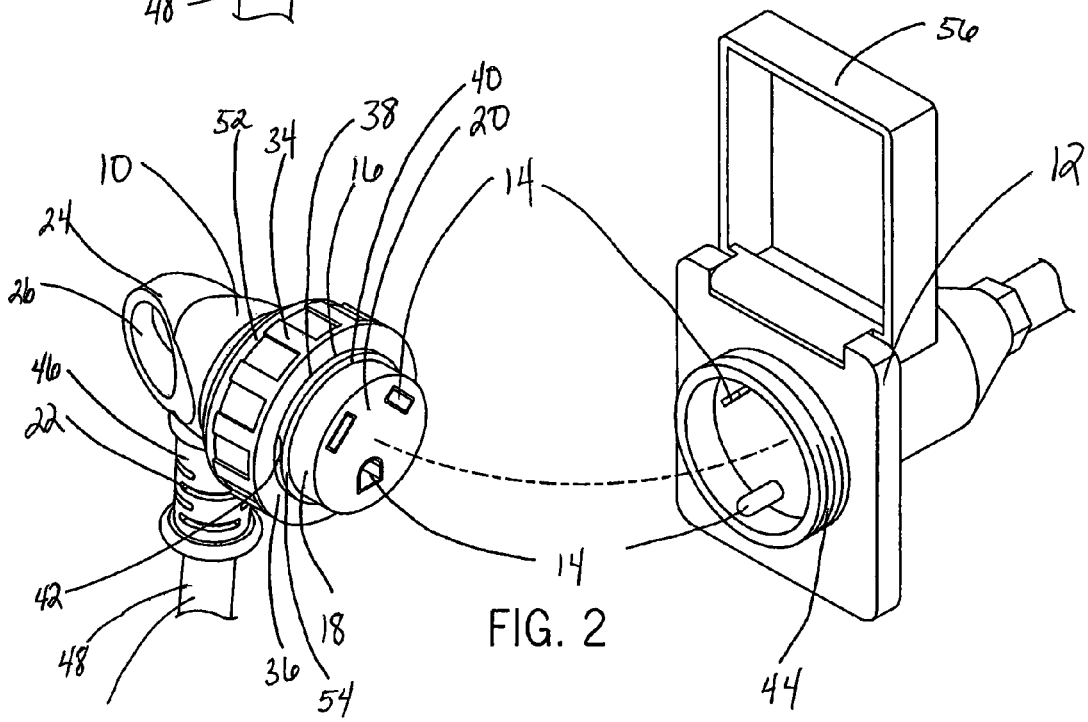
FIG. 2 is a perspective view of the electrical connector and connector-engaging member of FIG. 1 in the disengaged position.

FIGS. 1-4 illustrate that electrical connector includes both the connector 10 and connector-engaging member 12. Connector 10 and connector-engaging member 12 have slidably-engageable corresponding male-female engagement portions 14 as seen best in FIG. 2. FIG. 2 also illustrates that connector 10 includes a connector-body main portion 16 which has a forward portion 18 that terminates in a connecting face 20. Connecting face 20 includes the engagement means of connector 10 for axial engagement with engagement means of the connector-engaging member 12. Connector 10 also includes a connector-body cord-engagement portion 22 for permanent trans-axial securement of cord 48 to main portion 16 and a rearward gripping portion 24 for facilitating manual engagement/disengagement of connector 10 with connector-engaging member 12 as seen in FIGS. 1-4.

Figure 3:
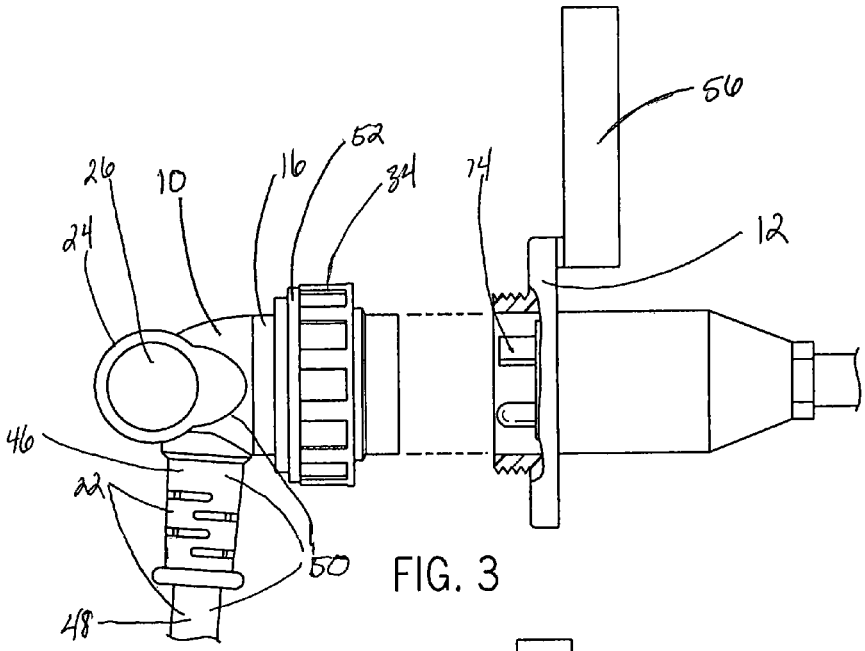
FIG. 3 is a side view of the electrical connector and connector-engaging member of FIG. 1 in the disengaged position.
Figure 4:
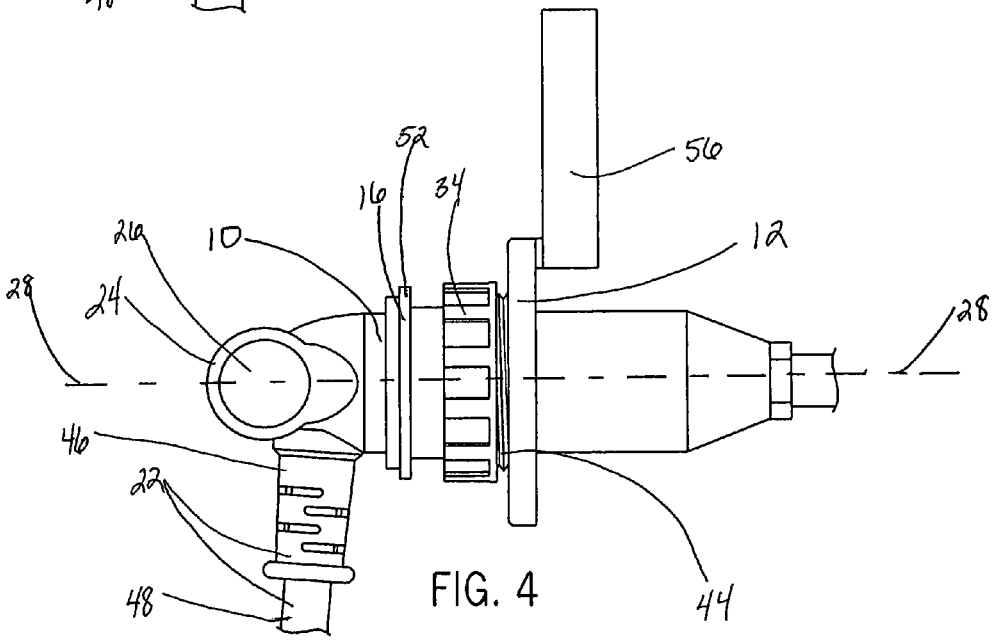
FIG. 4 is a side view of the electrical connector and connector-engaging member of FIG. 1 in the engaged position.

FIGS. 3-4 illustrate that gripping portion 24 can be a finger-receiving loop 26 which is located rearward of connector-body main portion 16. Loop 26 can have a substantially circular opening or can have an opening which is square-shaped or any other configuration which would be apparent to those skilled in the art.

Gripping portion 24 is also integrally formed with the remainder of connector-body main portion 16. The axial engagement movement is along a forward-rearward axis 28 which extends through connecting face 20 as seen in FIG. 4. FIG. 4 also illustrates that finger-receiving loop 26 is substantially along such axis 28.

Figure 6:
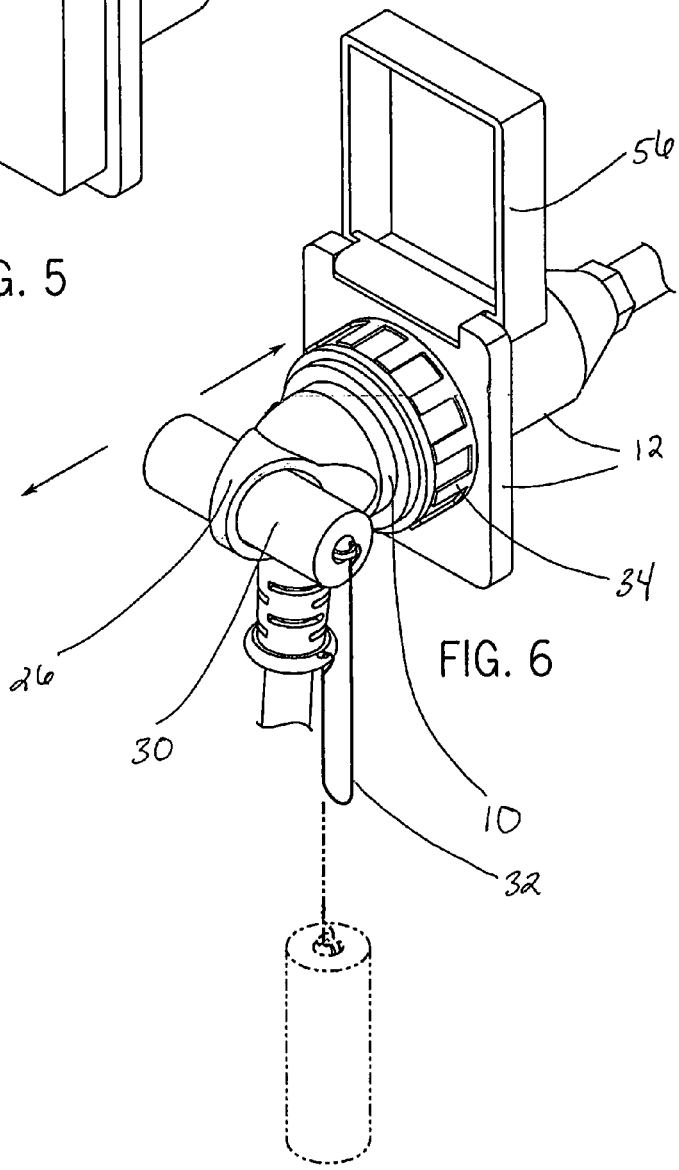
FIG. 6 is a perspective view of the electrical connector and connector-engaging member of FIG. 1 with the grip-bar and tether.

As seen in FIG. 6, connector 10 can also include a grip-bar 30 in some embodiments. Grip-bar 30 is configured for insertion through loop 26 to facilitate firm gripping for disengagement/engagement purposes. Some embodiments also include a tether 32 between grip-bar 30 and connector-body main portion 16 as seen in FIG. 6.

Connector-body main portion, connector-body cord portion and finger-receiving loop are an integrally formed polymeric piece. Grip-bar and tether are also integrally formed with connector-body main portion.

As seen in FIGS. 1-4, electrical connector 10 also includes a connecting ring 34. FIG. 2 illustrates details of connecting ring 34. Connecting ring 34 encircles and is loosely rotatable about forward portion 18 of connector-body main portion 16. Connecting ring 34 has a rearward inwardly-extending flange 36 which terminates at a circular inner edge 38. Connecting ring 34 includes a forward circular edge 40 which is rearward of connecting face 20 and a threaded inward wall 42 for threaded engagement with a threaded annulus 44 of connector-engaging member 12.

FIG. 2 illustrates that forward portion 18 of connector-body main portion 16 has rearward and forward outwardly-extending flanges 52, 54 between which inwardly-extending flange 36 of connecting ring 34 is located. This holds connecting ring 34 on connector-body forward portion 18 while allowing rotation thereabout for engagement with the threaded annulus 44 of connector-engaging member 12. Slidably-engageable corresponding male-female engagement portions 14 contact each other when the user pushes connector 10 into connector-engaging member 12, when male-female engagement portions 14 are connected, user rotates connecting ring 34 onto threaded annulus 44, thereby locking connector 10 and connector-engaging member 12 together.

As shown best in FIGS. 3-4, connector-body cord-engagement portion 22 includes a wire-connection portion 44 immediately rearward of forward portion 18 and along a forward-rearward axis 28 extending through connecting face 20. Connector-body cord-engagement portion 22 also includes a cord-receiving sleeve portion 48 extending trans-axially from wire-connection portion 46. Cord-receiving sleeve portion 46 can be angled off-perpendicular with respect to forward-rearward axis 28 and is of sufficient length to form a pistol grip 50 of connector-body main portion 16 as seen best in FIG. 4. Pistol grip 50 configuration makes it easy for user to grasp and manipulate connector 10 whether user is trying to engage or disengage connector 10 from connector-engaging member 12.

FIGS. 3-4 illustrate that rearward gripping portion 24 includes cord-receiving sleeve portion 48. Cord-receiving sleeve portion 48 is typically made of an insulating material and a protective sheath (which can be made of various plastic or rubber materials). Cord-receiving sleeve portion 48 may be round, flat or another shape as would be apparent to those skilled in the art. Rearward gripping portion 24 also includes finger-receiving loop 26 which is rearward of and integrally formed with the remainder of connector-body main portion 16.

Figure 5:
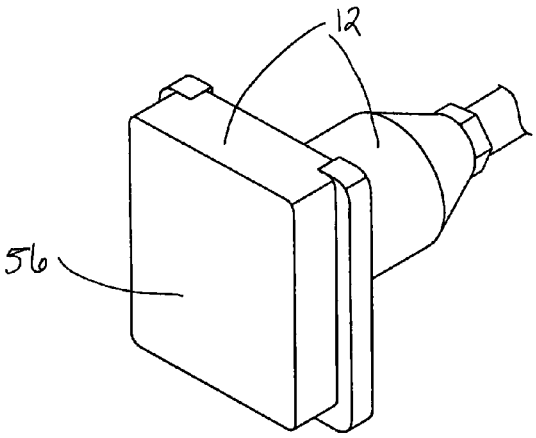
FIG. 5 is a perspective view of the connector-engaging member of FIG. 1 with cover closed.

FIG. 5 illustrates connector-engaging member 12. In some embodiments, connector-engaging member 12 has a cover 56 which is used when connector 10 and connector-engaging member 12 are disengaged. Cover 56, when closed, prevents rain, snow or other weather elements from contacting male/female engagement means 14 as cover 56 fully encloses such components. Cover 56 is hinged (not shown) and thereby allows rotation from an open to closed position by user. Cover 56 includes a grip-flange (not shown) to assist the user in opening the cover.

In some embodiments, connector-body main portion 16, connector-body cord-engaging portion 22 and/or finger-receiving loop 26 may include a small LED light (not shown) to assist the user in engaging/disengaging main portion 16 from connector-engaging member 12. The apparatus of this application is preferably fabricated of various plastic or rubber materials.

While the principles of this invention have been described in connection with specific embodiments, it should be understood clearly that these descriptions are made only by way of example and are not intended to limit the scope of the invention.

The invention claimed is:

1. In a straight-blade, cord-end-connected electrical connector for connection to a connector-engaging member, the connector and connector-engaging member having slidably-engageable corresponding male-female engagement means, the improvement wherein the connector has: (a) connector-body main portion including a forward portion terminating in a connecting face presenting the engagement means of the connector for axial engagement with the engagement means of the connector-engaging member; a connector-body cord-engagement portion for permanent trans-axial securement of a cord to the main portion; and a rearward gripping portion for facilitating manual engagement/disengagement of the connector with the connector-engaging member, the gripping portion is a finger-receiving loop rearward of and integrally formed with the remainder of the connector-body main portion, an axial engagement movement is along a forward-rearward axis extending through the connecting face and the finger-receiving loop is substantially along such axis; and (b) a grip-bar configured for insertion through the loop to facilitate firm gripping for disengagement/engagement purposes; and a tether between the grip-bar and the connector-body main portion, the grip-bar and the tether are integrally formed with the connector-body main portion.

2. The electrical connector of claim 1 wherein the connector-body main portion, the connector-body cord portion, and the rearward finger-receiving loop are an integrally formed polymeric piece.

3. The electrical connector of claim 1 further including a connecting ring encircling and loosely rotatable about the forward portion of the connector-body main portion, and wherein:

the connecting ring has (a) a rearward inwardly-extending flange terminating at a circular inner edge, (b) a forward circular edge which is rearward of the connecting face, and (c) a threaded inward wall for threaded engagement with a threaded annulus of the connector-engaging member; and the forward portion of the connector-body main portion has forward and rearward outwardly-extending flanges between which the inwardly-extending flange of the connecting ring is located, thereby holding the connecting ring on the connector-body forward portion while allowing rotation thereabout for engagement with the threaded annulus of the connector-engaging member.

4. The electrical connector of claim 3 wherein the gripping portion is a finger-receiving loop rearward of and integrally formed with the remainder of the connector-body main portion.

5. The electrical connector of claim 4 wherein axial engagement movement is along an forward-rearward axis extending through the connecting face and the finger-receiving loop is substantially along such axis.

6. The electrical connector of claim 4 wherein the connector-body main portion, the connector-body cord portion, and the rearward finger-receiving loop are an integrally formed polymeric piece.

7. The electrical connector of claim 6 wherein axial engagement movement is along an forward-rearward axis extending through the connecting face and the finger-receiving loop is substantially along such axis.

8. The electrical connector of claim 1 wherein the connector-body cord-engagement portion includes:

a wire-connection portion immediately rearward of the forward portion and along a forward-rearward axis extending through the connecting face; and a cord-receiving sleeve portion extending trans-axially from the wire-connection portion.

9. The electrical connector of claim 8 wherein the cord-receiving sleeve portion is angled off-perpendicular with respect to the forward-rearward axis and is of sufficient length to form a pistol grip of the connector-body main portion.

10. The electrical connector of claim 9 wherein the rearward gripping portion includes at least the cord-receiving sleeve portion.

11. The electrical connector of claim 10 wherein the connector-body main portion is an integrally formed polymeric piece.

12. The electrical connector of claim 10 wherein the rearward gripping portion further includes a finger-receiving loop rearward of and integrally formed with the remainder of the connector-body main portion.

13. The electrical connector of claim 12 wherein axial engagement movement is along the forward-rearward axis and the finger-receiving loop is substantially along such axis.

14. The electrical connector of claim 13 wherein the connector-body main portion is an integrally formed polymeric piece.

15. The electrical connector of claim 14 further including a connecting ring encircling and loosely rotatable about the forward portion of the connector-body main portion, and wherein:

the connecting ring has (a) a rearward inwardly-extending flange terminating at a circular inner edge, (b) a forward circular edge which is rearward of the connecting face, and (c) a threaded inward wall for threaded engagement with a threaded annulus of the connector-engaging member; and the forward portion of the connector-body main portion has forward and rearward outwardly-extending flanges between which the inwardly-extending flange of the connecting ring is located, thereby holding the connecting ring on the connector-body forward portion while allowing rotation thereabout for engagement with the threaded annulus of the connector-engaging member.

* * * * *